United States Patent [19]

Dion et al.

[11] 3,943,666

[45] Mar. 16, 1976

[54] METHOD AND APPARATUS FOR BURNISHING FLEXIBLE RECORDING MATERIAL

[75] Inventors: C. Norman Dion; Tom Y. Idemoto, both of San Jose, Calif.

[73] Assignee: Dysan Corporation, Santa Clara, Calif.

[22] Filed: July 31, 1974

[21] Appl. No.: 493,447

[52] U.S. Cl. ..... 51/106 R; 51/51; 51/75; 51/132; 51/281 R

[51] Int. Cl.[2] ..... B24B 7/04; B24B 1/00

[58] Field of Search ..... 51/51, 75, 104, 105 R, 51/106 R, 132, 209 R, 281 R, 281 SF, 206 R; 269/310, 275; 427/128, 130

[56] References Cited

UNITED STATES PATENTS

| | | | |
|---|---|---|---|
| 1,076,862 | 10/1913 | Barteaux | 51/75 X |
| 2,590,325 | 3/1952 | Kamp | 51/51 |
| 2,867,057 | 1/1959 | Kakiuch | 51/51 |
| 3,284,962 | 11/1966 | Hott | 269/310 X |
| 3,343,306 | 9/1967 | Highberg | 51/209 R X |
| 3,364,630 | 1/1968 | Rusk | 51/206 R X |
| 3,398,011 | 8/1968 | Neirotti | 117/237 |
| 3,481,083 | 12/1969 | David et al. | 51/281 R |
| 3,486,274 | 12/1969 | David | 51/132 |
| 3,599,961 | 8/1971 | Morgan | 269/275 |
| 3,601,932 | 8/1971 | Elliott | 51/132 X |
| 3,676,216 | 7/1972 | Abitboul | 117/237 |
| 3,818,649 | 6/1974 | Klievoneit | 51/327 X |
| 3,839,830 | 10/1974 | Bair | 269/310 |
| 3,863,395 | 2/1975 | Brown | 51/401 X |

*Primary Examiner*—Al Lawrence Smith
*Assistant Examiner*—Nicholas P. Godici
*Attorney, Agent, or Firm*—Townsend and Townsend

[57] ABSTRACT

A method and apparatus for treating the recording layer of flexible recording elements to remove protruding agglomerated particles formed during the fabrication process and to provide an extremely smooth surface finish on the order of 1.8AA or less. Several embodiments are disclosed for treating both annular recording discs and roll type recording media. The method comprises burnishing the recording layer surface with a hard smooth abrasive member while supporting the flexible recording element on a resilient backing surface and observing key parameters.

26 Claims, 10 Drawing Figures

METHOD AND APPARATUS FOR BURNISHING FLEXIBLE RECORDING MATERIAL

BACKGROUND OF THE INVENTION

This invention relates to the treatment of flexible recording elements to eliminate recording layer defects.

Flexible recording elements have found increasing use in several branches of industry. Audio recording tape, for example, is increasingly employed in the sound recording industry as a storage medium for speech and musical compositions. Similarly, video tape has found increasing use in the television industry as a storage medium for television programs. Recently, flexible annular recording discs have been introduced for use as a digital data storage device in the data processing industry.

The above flexible recording elements all share common manufacturing techniques. In a typical manufacturing process, a sheet or roll of durable flexible substrate material, such as Mylar, is coated with a solution having desired magnetic recording characteristics, such as iron oxide contained in a resin binder. After coating, the sheet is subjected to a heat treating step during which the solution is cured by baking or the like. The treated sheet is then trimmed to the appropriate shape by slitting, slicing, or in the case of annular recording discs, by punching or stamping to an annular shape. After trimming, a suitable lubricant is applied to the recording surface, after which the recording element is tested.

The manufacturing yield of such flexible recording elements in the past has suffered from the fact that during the coating process relatively large agglomerated particles or chunks of iron oxide are naturally formed in the recording layer. These agglomerates project outwardly from the recording layer surface and, unless removed, adversely affect the performance of the recording element in the following manner.

The recording and reproduction fidelity of a magnetic recording element is directly related to the separation distance between the recording surface and the associated magnetic transducer. For best results, this separation distance should be substantially invariant as the recording surface sweeps past the transducer. However, when a portion of the recording surface having a projecting agglomerate passes over the surface of the magnetic transducer, the separation distance therebetween is momentarily increased, thereby alterating the strength of the magnetic field penetrating the recording layer during recording or the strength of the field emanating from the recording layer which is sensed by the transducer during reproduction. The result is degradation of the signal and, in severe cases, complete loss of information.

This problem is compounded by the fact that one or more agglomerates can be extracted from the recording layer and attached to the surface of the transducer under typical operating pressures and temperatures. Thereafter, as other portions of the recording surface are swept past the transducer surface, the attached agglomerate cuts into and removes portions of the recording layer. In aggravated cases, such as in digital applications in which the transducer is swept across the surface of a flexible disc element rotating at a high speed, the entire recording layer can be destroyed in a matter of seconds.

An additional problem which serves to impair the manufacturing yield of flexible recording elements of the type noted above is the uneveness of the surface of the recording layer after the curing step is completed. Irregular undulations in the recording surface are known to produce premature wear of the magnetic transducer suface, thus shortening the usful life of this latter element.

Conventional techniques emloyed in the past to improve the recording layer surface characteristics of flexible recording elements include hot or cold pressing between hard or soft rollers, and high speed sanding or polishing with loose abrasive materials in a manner analogous to techniques employed in polishing optical devices. To date, such efforts have met with only limited success.

SUMMARY OF THE INVENTION

The invention comprises a method and apparatus for treating the recording layer of flexible recording elements to produce a smooth surface free from protruding agglomerates, surface undulations and other surface irregularities. This treatment is effected by burnishing the recording layer surface with a hard smooth abrasive member having a surface finish characteristic lying in a predetermined range while supporting the flexible recording element on a resilient backing surface having hardness, resiliency and surface finish characteristics lying within predetermined ranges. The disc and abrasive member are rotated at first and second speeds lying in preselected ranges and the abrasive member applies a normal force to the disc lying within a predetermined range.

In a first specific embodiment especially adapted for use with annular flexible recording discs, a disc is mounted on a circular platen having a resilient backing layer supported by a stiff plate, and the platen and disc are rotated at a first speed. A cylindrical abrasive member is placed in pressure contact with the recording surface, the pressure having a predetermined magnitude, and rotated at a second speed for a predetermined burnishing period. The cylinder may comprise a right circular cylinder employing either the cylindrical surface or an end wall as the burnishing surface, the latter comprising either a flat surface or a surface having a regularly arranged pattern of alternate lands and grooves radially extending from the center of the surface and angularly disposed about the axis of rotation of the cylinder. The cylinder may also comprise a truncated conical cylinder.

In a second embodiment especially adapted for use in treating roll-type flexible recording elements, e.g. magnetic tape, the backing member comprises a resilient annular cylindrical member surrounding a hard core material and the abrasive member comprises a cylinder, the tape being passed through a nip provided by the backing member and the abrasive member. The two members have structural and operational parameters similar to those of the disc embodiment.

Flexible recording elements treated in accordance with the method of the invention possess an extremely fine surface finish of no more than about 1.8AA and a recording layer surface which is substantially free of protruding agglomerates. Application of the invention to flexible recording discs has been found to increase the manufacturing yield by one order of magnitude.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
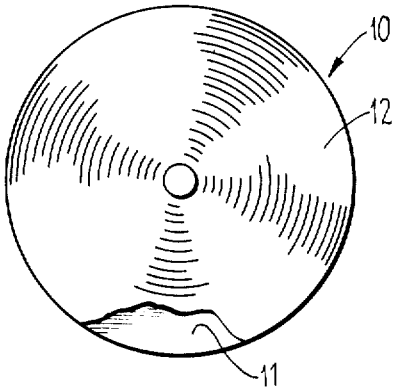
FIG. 1 is a top plan view partially broken away of an annular flexible recording disc.
Figure 2:
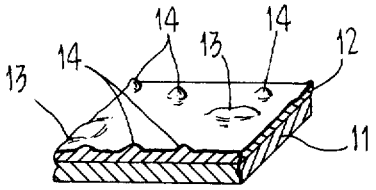
FIG. 2 is an enlarged perspective view in section illustrating the composition of the flexible recording element.

Turning now to the drawings, FIG. 1 shows a flexible annular recording disc 10 of the type used in rotating disc file digital data storage units. Recording element 10 is composed of a base layer 11, typically fabricated from Mylar or an equivalent durable flexible substance, and a recording layer 12 composed of magnetic material such as iron oxide particles in a resin binder. As best shown in FIG. 2, after the disc has been coated and cured in accordance with the manufacturing process noted supra, the recording layer 12 typically exhibits an irregular surface with undulations 13 and externally projecting agglomerated particles of iron oxide 14.

Figure 3:
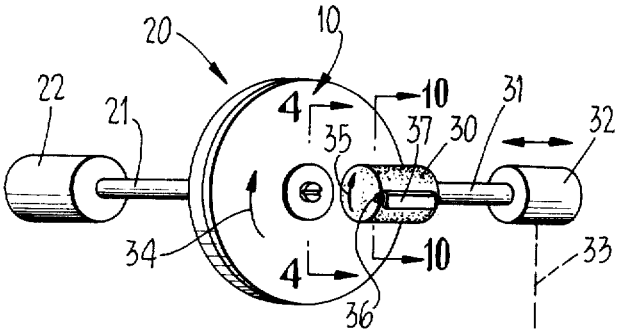
FIG. 3 is a schematic view of a first embodiment of the invention for burnishing a recording element of the type shown in FIG. 1.
Figure 4:
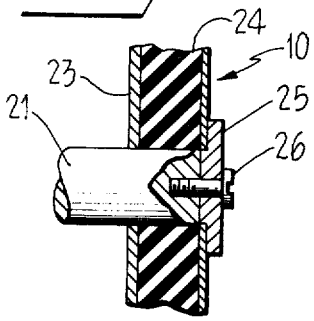
FIG. 4 is an enlarged partial sectional view taken along lines 4-13 4 4—FIG. 3.

FIG. 3 illustrates a first embodiment of the invention for treating the recording layer 12 of disc 10 to remove particles 14 and to reduce the magnitude of undulations 13 to or below a desired suface smoothness. With reference to FIG. 3, recording disc 10 is placed on the support surface of a circular platen-20 having a shaft 21 coupled to a motor 22. As best shown in FIG. 4, platen 20 has a support plate 23 preferably fabricated from aluminum or other suitable relatively rigid material and a resilient layer 24 preferably fabricated from urethane or other suitable resilient material such as rubber or a resilient plastic. An optional clamp comprising a small apertured disc 25 secured to shaft 21 by means of a screw 26 may be provided for fastening disc 10 to platen 20. In practice, however, the surface friction between the bottom surface of disc 10 and the receiving surface of resilient layer 24 has been found sufficient to hold discs 10 having a single recording layer 12 on resilient layer 24.

Disposed at substantially a right angle to the axis of rotation of platen 20 is an abrasive element 30 in the form of a right circular cylinder having a central shaft 31 coupled to a second motor 32 for rotation thereby.

Abrasive element 30 is preferably fabricated from alumina having the surface finish specified below. Other suitable materials are ruby, diamond, granite, stone, brass and steel. Other equivalent materials will occur to those skilled in the art.

A suitable conventional mechanical translating mechanism schematically indicated by broken lines 33 is provided to enable element 30 to be placed in pressure contact with disc 10 during burnishing and to be withdrawn from the surface of disc 10 a sufficient distance to permit removal of disc 10 after burnishing and mounting of an unburnished disc onto platen 20 prior to burnishing. Such mechanisms are well known and accordingly further details thereof have been omitted.

Figure 10:
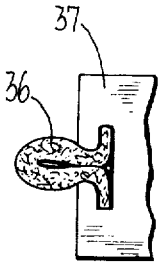
FIG. 10 is an enlarged sectional view illustrating the cleaning wick and holder of the FIG. 3 embodiment.

A cleaning wick 36 secured in a suitably configured clamping device 37, shown in section in FIG. 10, is provided for removing loose material from the surface of cylinder 30 during operation.

In use, platen 20 and abrasive element 30 are rotated in the directions indicated by arrows 34, 35 at the speeds indicated below, with the abrasive surface of cylinder 30 in pressure contact with the recording surface 12. For optimum results, the burnishing process is conducted over the time periods set forth below.

Figure 5:
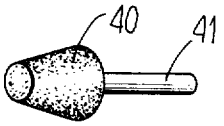
FIG. 5 illustrates an alternate embodiment of the abrasive element for use with the embodiment of FIG. 3.

FIG. 5 shows an alternate embodiment of the abrasive element for use with the embodiment shown in FIG. 3 in which the abrasive element comprises a cylinder 40 in the shape of a truncated cone having an axial shaft 41 adapted to be coupled to driving motor 32. The taper of cylinder 40 is preferably selected so that the linear speed along the surface varies in the same manner as the variation of linear speed with increasing radius along the surface of disc 10.

Figure 6:
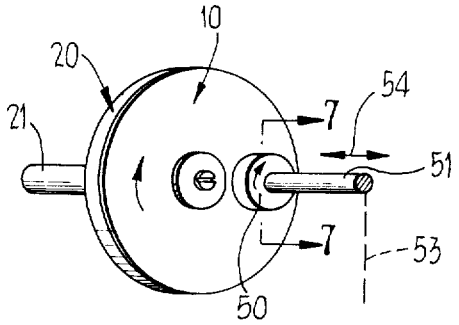
FIG. 6 is a schematic view of a second embodiment of the invention for use with the recording element of FIG. 1.

FIG. 6 shows an alternate embodiment in which the abrasive element comprises a cylindrical disc 50 having a body shaft 51 adapted to be coupled to a motor such as motor 32 shown in FIG. 3. In this embodiment, the free face (hidden) of disc 50 functions as the abrasive surface. In addition, a conventional mechanical translating mechanism indicated schematically by broken line 53 is provided for the same purpose as device 33 of FIG. 3 for enabling translational movement of disc 50 and shaft 51 in the directions indicated by arrow 54.

Figure 7:
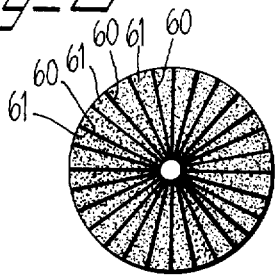
FIG. 7 is a front elevational view of the burnishing surface of an alternate embodiment of the abrasive element shown in FIG. 6.
Figure 8:
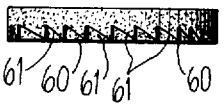
FIG. 8 is a side elevational view of the abrasive element of FIG. 7.

FIGS. 7 and 8 show an alternate embodiment of the disc 50 of FIG. 5 in which the abrasive end surface 60 is provided with a plurality of alternate land and groove portions 61, 62 radiating from the center of the disc.

Referring again to FIG. 3, as noted above recording disc 10 is burnished by rotating disc and cylinder 30 while pressing the abrasive surface of cylinder 30 against recording surface 12 of the disc 10. Best results have been obtained with a platen 20 having a resilient layer 24 composed of urethane having a surface finish of about 63 AA, corresponding to a maximum surface deviation of 63 microinches measured with a 0.030 inch cut-off, a 50 durometer hardness and a 50 percent resiliency; and a ceramic cylinder having a radius of 0.75 inch with a surface finish of 35AA also measured with a 0.030 inch cut-off; with a cylinder to disc force of about 8.8 pounds. The optimum speed of the cylinder is about 890 RPM, corresponding to a linear speed of about 70 inches per second, while the optimum speed of the platen 20 is about 30 RPM corresponding to a linear surface speed on the outer diameter of disc 10 of about 12 inches per second and a linear surface speed on the inner diameter of disc 10 of about 6 inches per second. The optimum burnishing time with the above parameters is about 17 seconds. Discs 10 having an acceptable surface finish, however, can be produced over the following ranges of critical parameters:

Platen surface finish—50–80AA
Platen hardness—40–70 durometer
Platen resiliency—40–70%
Cylinder surface finish—30–40AA
Cylinder to disc force: 6.6–11.0 pounds
Cylinder speed: 600–1200 RPM (31.5 to 94.2 inches per second)
Disc speed: 20–60 RPM (8.0–28.0 inches per second O.D.; 4.0 –14.0 inches per second I.D.)
Burnishing time—12–22 seconds As will be apparent to those skilled in the art, burnishing times longer than 22 seconds may be employed, if desired; however, any improvement in quality of the surface finish obtained with prolonged burnishing periods is typically offset by the increased cost necessitated thereby. Such discs 10 burnished in accordance with the above critical parameters have been found to exhibit surface deviations of less than 1.8AA with less than 5 microinches of the recording surface layer 12 being removed during the burnishing process. Most importantly, for reasons not fully understood, any protruding agglomerates embedded in recording layer 12 are removed by the burnishing process.

Figure 9:
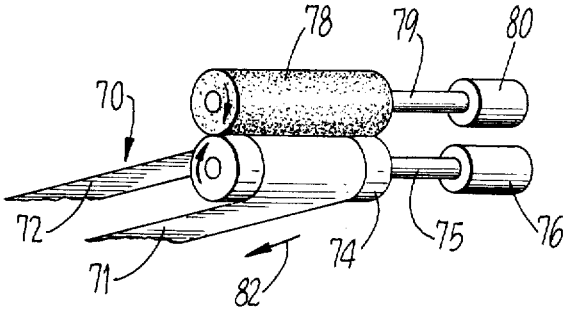
FIG. 9 is a schematic diagram of an alternate embodiment of the invention for burnishing roll-type flexible recording media.

FIG. 9 shows an apparatus for burnishing roll form recording media 70 having a flexible substrate 72 and a recording layer 71 on one surface thereof. As shown in the Fig., the recording media 70 is looped around a resilient backing cylinder 74 with the flexible substrate 72 in surface contact therewith. Cylinder 74 has an axial shaft 75 coupled to a driving motor 76. A rotatable abrasive cylinder 78 having an axial shaft 79 coupled to a driving motor 80 is also provided, with the media 70 grasped in the nip between the surfaces of cylinders 74 and 78.

During burnishing, media 70 is translated pass the nip from a conventional feed roller to a take-up reel (not shown) in the direction of arrow 82. If desired, additional conventional feed mechanisms may be provided to assist in translating media 70 past the burnishing station elements. The optimum and acceptable burnishing parameters for the device of FIG. 9 are substantially similar to those discussed above.

As will now be apparent, the invention provides a low cost method and apparatus for treating the surface of flexible recording media to improve the recording characteristics thereof. In practice, the invention has been found to increase the manufacturing yield of flexible recording discs by one order of magnitude. The invention readily lends itself to automated operation when burnishing either discs or tapes and requires only low cost readily available materials for implementation.

While the above provides a full and complete disclosure of the invention, various modifications, alternate constructions and equivalents may be employed without departing from the true spirit and scope of the invention. Therefore, the above description and illustrations should not be construed as limiting the scope of the invention, which is defined by the appended claims.

What is claimed is:

1. A method of treating the recording surface of a flexible recording element to remove protruding agglomerates and improve the surface smoothness, said method comprising the steps of:

a. supporting said flexible recording element on a substantially resilient compressible support surface;
b. translating said recording surface of said recording element past an abrading region at a first rate; and
c. abrading said recording surface during translation thereof past said abrading region for a predetermined period with an abrasive element having substantially less resiliency than said compressible surface by moving the surface of said abrasive element past said abrading region at a second rate different from said first rate while pressing said recording surface against said support surface with said abrasive element with sufficient force to compress said support surface at said abrading region.

2. The method of claim 1 wherein said first rate is in the range of from about 4 to about 28 inches per second and said second rate is in the range from about 30 to about 95 inches per second.

3. The method of claim 2 wherein said first rate is in the range from about 6 to about 12 inches per second and said second rate is about 70 inches per second.

4. The method of claim 1 wherein the force between said abrasive element and said support surface is in the range from about 6.5 to about 11 pounds.

5. The method of claim 4 wherein said force is about 8.8 pounds.

6. The method of claim 1 wherein said predetermined period is in the range from about 12 to about 22 seconds.

7. The method of claim 6 wherein said period is about 17 seconds.

8. An apparatus for treating the recording surface of a recording element to remove protruding agglomerates and improve surface smoothness, said recording element having a flexible substrate with front and back surfaces, said apparatus comprising:

a resilient compressible backing means for providing a substantially resislient yielding support surface for one of said surfaces of said flexible recording element;
an abrasive element adapted to be placed in surface contact with said recording surface at an abrading region for pressing said recording element against said resilient backing means with sufficient force to compress said backing means at said abrading region, said abrasive element having substantially less resiliency than said backing means;
means for providing relative movement between said abrasive element and said recording surface and;
means for providing said force to compress said backing means.

9. The apparatus of claim 8 wherein said resilient backing means has a hardness and a resiliency in the range from 40–70 durometer and 40–70 percent, respectively.

10. The apparatus of claim 9 wherein said hardness and resiliency are about 50 durometer and 50 percent, respectively.

11. The apparatus of claim 8 wherein said resilient backing means is provided with a surface finish in the range from about 50 to about 80AA.

12. The apparatus of claim 11 wherein said surface finish is about 63AA.

13. The apparatus of claim 8 wherein said abrasive element comprises a ceramic cylinder having a surface finish in the range from about 30 to about 40AA.

14. The apparatus of claim 13 wherein said surface finish of said cylinder is about 35AA.

15. The apparatus of claim 13 wherein said cylinder is a right circular cylinder.

16. The apparatus of claim 13 wherein said cylinder is a disc having an abrasive free end surface.

17. The apparatus of claim 16 wherein said abrasive surface is provided with a plurality of radially extending alternate land and groove portions.

18. The apparatus of claim 13 wherein said cylinder is a truncated cone.

19. The apparatus of claim 9 wherein said relative movement means comprises means for rotating said abrasive element at a first predetermined speed.

20. The apparatus of claim 19 wherein said first predetrmined speed is in the range from about 600 to about 1200 revolutions per minute.

21. The apparatus of claim 20 wherein said first predetermined speed is about 900 revolutions per minute.

22. The apparatus of claim 19 wherein said relative movement means further includes means for rotating said resilient backing means at a second predetermined speed.

23. The apparatus of claim 22 wherein said second predetermined speed is in the range from about 20 to about 60 revolutions per minute.

24. The apparatus of claim 23 wherein said speed is about 30 revolutions per minute.

25. The apparatus of claim 9 wherein said flexible recording element is pressed against said resilient backing means with a force in the range from about 6.6 to about 11.0 pounds.

26. The apparatus of claim 25 wherein said force is about 8.8 pounds.

* * * * *